US011289239B2

(12) United States Patent
Furuta

(10) Patent No.: US 11,289,239 B2
(45) Date of Patent: Mar. 29, 2022

(54) ELECTRIC WIRE, CABLE HARNESS AND FLYING OBJECT

(71) Applicant: JUNKOSHA INC., Ibaraki (JP)

(72) Inventor: Hidenori Furuta, Ibaraki (JP)

(73) Assignee: JUNKOSHA INC., Ibaraki (JP)

( * ) Notice: Subject to any disclaimer, the term of this patent is extended or adjusted under 35 U.S.C. 154(b) by 0 days.

(21) Appl. No.: 16/970,476

(22) PCT Filed: Feb. 7, 2019

(86) PCT No.: PCT/JP2019/004490
§ 371 (c)(1),
(2) Date: Aug. 17, 2020

(87) PCT Pub. No.: WO2019/163541
PCT Pub. Date: Aug. 29, 2019

(65) Prior Publication Data

US 2021/0020328 A1 Jan. 21, 2021

(30) Foreign Application Priority Data

Feb. 20, 2018 (JP) ..... JP2018-028213

(51) Int. Cl.
*H01B 7/02* (2006.01)
*H01B 3/36* (2006.01)
(Continued)

(52) U.S. Cl.
CPC ..... *H01B 7/0045* (2013.01); *H01B 7/02* (2013.01); *H01B 13/01263* (2013.01);
(Continued)

(58) Field of Classification Search
CPC .. H01B 7/0045; H01B 7/02; H01B 13/01263; H01B 3/396; H01B 3/36; H01B 3/445;
(Continued)

(56) References Cited

U.S. PATENT DOCUMENTS 5,149,917 A * 9/1992 Sawada ..... B60R 16/0215 174/110 R
6,900,391 B1 * 5/2005 Maeda ..... H01B 7/0009 174/128.1
(Continued)

FOREIGN PATENT DOCUMENTS

JP 2015-138628 A 7/2015
JP 2015-167092 A 9/2015
JP 2017-204409 A 11/2017

OTHER PUBLICATIONS

Mach 12, 2019, International Search Report issued for related PCT application No. PCT/JP2019/004490.
(Continued)

*Primary Examiner* — Timothy J Thompson
*Assistant Examiner* — Michael F McAllister
(74) *Attorney, Agent, or Firm* — Paratus Law Group, PLLC

(57) ABSTRACT

There is provided an electric wire having a conductor total cross-sectional area of 2 $mm^2$ or less and high reliability. The electric wire includes: a twisted wire conductor (2) including a plurality of strand conductors (21 to 27) twisted together with each other and having a total cross-sectional area of the plurality of strand conductors of 2 $mm^2$ or less; and a covering member (3) made from a resin material having a flexural modulus of 0.6 GPa or more and covering the twisted wire conductor so that an inner wall thereof is in contact with an outer peripheral surface of the twisted wire conductor, wherein the twisted wire conductor (2) has, on an outer peripheral surface thereof, recesses having a maximum depth of 5% or less of a maximum diameter of the twisted wire conductor in a cross section perpendicular to a length direction of the twisted wire conductor and containing boundaries of the plurality of strand conductors.

28 Claims, 8 Drawing Sheets

(51) Int. Cl.

| | |
|---|---|
| ***H01B 7/00*** | (2006.01) |
| ***H01B 13/012*** | (2006.01) |
| *H01B 3/30* | (2006.01) |
| *H01B 3/44* | (2006.01) |

(52) U.S. Cl.
CPC ..... *H01B 3/306* (2013.01); *H01B 3/36* (2013.01); *H01B 3/445* (2013.01)

(58) Field of Classification Search
CPC .... H01B 7/0275; H01B 1/026; H01B 7/0009; H01B 7/00216; H01B 5/08; H01R 4/185
USPC ..... 174/72 A
See application file for complete search history.

(56) References Cited

U.S. PATENT DOCUMENTS

| | | | | |
|---|---|---|---|---|
| 8,519,269 | B2 * | 8/2013 | Tsukamoto | C22F 1/08 174/128.1 |
| 11,069,459 | B2 * | 7/2021 | Kobayashi | H01B 7/0275 |
| 2006/0011378 | A1 * | 1/2006 | Maeda | H01B 13/0006 174/128.1 |
| 2017/0243678 | A1 * | 8/2017 | Stadler | H01B 11/12 |
| 2018/0175574 | A1 * | 6/2018 | Kihara | H01R 4/70 |

OTHER PUBLICATIONS

Mach 12, 2019, International Search Opinion issued for related PCT application No. PCT/JP2019/004490.
Jun. 9, 2020, English-language translation of the International Search Opinion issued for related PCT Application No. PCT/JP2019/004490.

* cited by examiner

ELECTRIC WIRE, CABLE HARNESS AND FLYING OBJECT

CROSS REFERENCE TO PRIOR APPLICATION

This application is a National Stage Patent Application of PCT International Patent Application No. PCT/JP2019/004490 (filed on Feb. 7, 2019) under 35 U.S.C. § 371, which claims priority to Japanese Patent Application No. 2018-028213 (filed on Feb. 20, 2018), which are all hereby incorporated by reference in their entirety.

TECHNICAL FIELD

The present invention relates to a small-diameter electric wire having a conductor total cross-sectional area of 2 $mm^2$ or less, and a cable harness and a flying object including the same.

BACKGROUND ART

An electric wire capable of achieving high reliability and light weight at the same time may be required. In particular, the electric wire used for the flying object such as artificial satellites or aircrafts is required to have extremely high reliability and light weight. This is because an accident such as falling does not only generate heavy economic loss but also often directly connects to a human life. In the flying object, light weight is strongly required. Even a slight increase in weight is to dramatically increase energy consumed for flying, and thus, cost for flying.

Patent Literature 1 discloses an insulated electric wire in which a flexural modulus of an insulator layer material is 2.0 GPa or more and an adhesive force between a conductor and an insulator layer is 30 N or more in insulated electric wires having a small diameter of 1.1 mm or less, with respect to a request to prevent disconnection due to a tensile load at the time of wiring the insulated electric wires used for wiring of a vehicle or device such as an automobile.

Since the adhesive force between the insulator layer, which is in contact with an outer peripheral surface of the conductor, and the conductor is 30 N or more, integration of the insulator layer and the conductor is maintained without peeling between the insulator layer and the conductor even with respect to a large tensile load applied to the insulated wire, and both of them can be cooperatively resistant and can improve a conductor breaking strength against the tensile load by setting a flexural modulus of a material constituting the insulator layer to 2.0 GPa or more.

PRIOR ART DOCUMENT

Patent Literature

Patent Literature 1: JP-A-2015-138628

SUMMARY OF INVENTION

Problem to be Solved by the Invention

However, in order to use the electric wire described in Patent Literature 1 as, for example, an electric wire in the flying object, there is room for improvement to obtain higher reliability.

The present invention has been made to solve the above problems, and an object thereof is to propose an electric wire having high reliability even with such a small diameter that a conductor total cross-sectional area is 2 $mm^2$ or less.

Means for Solving the Problem

In order to achieve the above object, an electric wire according to the present invention includes: a twisted wire conductor including a plurality of strand conductors twisted together with each other and having a total cross-sectional area of the plurality of strand conductors of 2 $mm^2$ or less; and a covering member made from a resin material having a flexural modulus of 0.6 GPa or more and covering the twisted wire conductor so that an inner wall thereof is in contact with an outer peripheral surface of the twisted wire conductor, wherein the twisted wire conductor has, on an outer peripheral surface thereof, recesses having a maximum depth of 5% or less of a maximum diameter of the twisted wire conductor in a cross section perpendicular to a length direction of the twisted wire conductor and containing boundaries of the plurality of strand conductors.

In the electric wire according to the present invention, the depth of the recesses is preferably 3% or less of the maximum diameter of the twisted wire conductor.

In the electric wire according to the present invention, the depth of the recesses is preferably 0.5% or more of the maximum diameter of the twisted wire conductor.

In the electric wire according to the present invention, the depth of the recesses is preferably 0.2 mm or less.

In the electric wire according to the present invention, the outer peripheral surface of the twisted wire conductor is preferably separated from the covering member in the recesses.

In the electric wire according to the present invention, the plurality of strands is made from seven strands.

In the electric wire according to the present invention, the twisted wire conductor is preferably a compressed twisted wire conductor.

In the electric wire according to the present invention, a compression ratio of the compressed twisted wire conductor is preferably 90% or more.

In the electric wire according to the present invention, the maximum diameter of the twisted wire conductor is preferably 30% or more and 85% or less of an outer diameter of the covering member.

In the electric wire according to the present invention, the outer diameter of the covering member is preferably 0.4 mm or more and 3 mm or less.

In the electric wire according to the present invention, the covering member preferably contains one or more of resins selected from a group consisting of polyether ether ketone, thermoplastic fluorine resin, crosslinking thermoplastic fluorine resin, and polyimide.

A cable harness according to the present invention includes the electric wire according to the present invention and a connector that is connected to the electric wire and has an engagement portion engageable with another electrical apparatus.

A flying object according to the present invention includes the cable harness according to the present invention and an electrical apparatus.

Effect of Invention

Even though the conductor total cross-sectional area is 2 $mm^2$ or less, it is possible to provide an electric wire having high reliability.

EMBODIMENTS FOR CARRYING OUT THE INVENTION

Figure 1A:
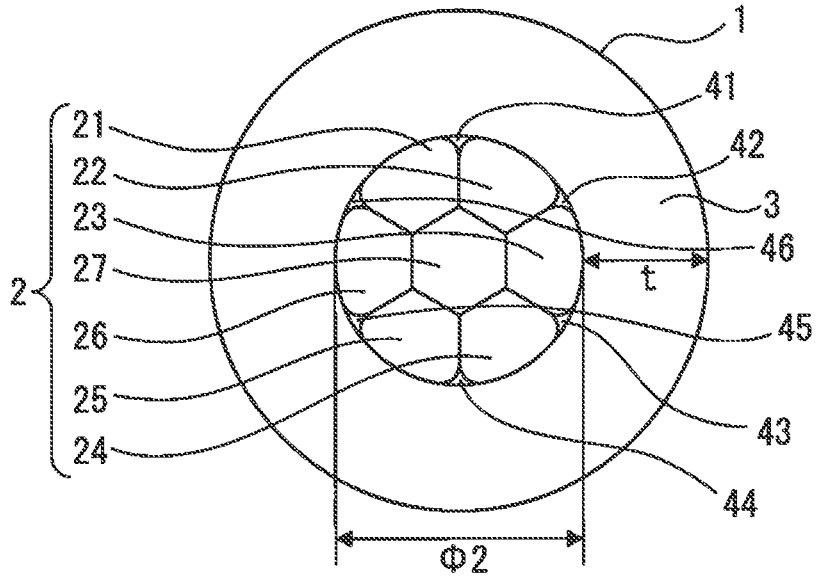
FIGS. 1A and 1B are views showing an example of an electric wire according to the present invention.

Hereinafter, a structure of an electric wire according to an aspect of the present disclosure will be described with reference to the drawings. However, it should be noted that a technical scope of the present disclosure is not limited to the embodiments and covers the claimed invention and equivalents thereof. In the following description and drawings, constituent elements having same functional configuration are denoted by the same reference signs to omit repeated description.

The electric wire according to the claims of the present application includes a twisted wire conductor in which a total cross-sectional area of a plurality of strand conductors is 2 $mm^2$ or less. Here, the total cross-sectional area of the plurality of strand conductors is a total value of cross-sectional areas of the plurality of respective strand conductors on a plane perpendicular to a longitudinal direction of the electric wire. Although details will be described later, metal materials are used for the strand conductor in view of electrical resistance. The metal materials have a higher density than a covering member made from a resin or the like, etc., and thus have a large influence on a weight of the electric wire. Therefore, a cross-sectional area of the twisted wire conductor is severely restricted in view of the weight of the electric wire. Therefore, a conductor having a small diameter is used within a range where a necessary amount of electric current can flow.

The total cross-sectional area of the strand conductor may be 2 $mm^2$ or less as described above, but by setting it to 0.85 $mm^2$ or less, an increase in weight of the electric wire by the strand conductor can be minimized.

On the other hand, in such a thin twisted wire conductor, it is difficult to ensure tensile strength of the conductor itself. Correspondingly, a material and a structure of the covering member of the electric wire are selected so as to satisfy the required reliability. For example, by applying a resin material having a flexural modulus of a predetermined magnitude, it is possible to increase mechanical strength of the electric wire against a tensile load or the like.

However, the present inventors have found that, in the electric wire in which a thin conductor and a resin material having a large elastic modulus are combined as described above, other characteristics that may cause a problem in reliability may be remarkably expressed. Since properties of elastic deformation of the resin material is dominant with respect to a shape of the electric wire made from such a combination, even when the electric wire is deformed by an external force, properties (shape restoring force) to return to an original shape immediately when the application of the external force is removed are strong. Therefore, when wiring work is performed in a limited space, large restriction may be caused on the work. In addition, a connector fixed in a state such as temporal tacking deviates due to the restoring force of the electric wire and comes into contact with peripheral electronic equipment or other electric wires, which may cause physical damage. Alternatively, a stress due to the restoring force of the electric wire may be applied for a long period of time to a board main body or a solder joint portion to which the electric wire is connected, which may cause creep rupture or the like.

By thinning the covering member in accordance with a thin diameter of the conductor, it is possible to reduce elastically deformed electric wire from returning to an original shape (hereinafter referred to as "springback"), but it becomes difficult to secure insulation reliability in the thinned covering member.

In contrast, the twisted wire conductor of the electric wire according to the claims of the present application includes, at the outer peripheral surface thereof, a recess including a boundary of the plurality of strand conductors with a depth of 5% or less of a maximum diameter of the twisted wire conductor. In other words, the recess between the strands is limited to a small depth as compared with a general twisted wire or a common compression conductor while being a twisted wire. In the electric wire formed by combining a small-diameter conductor and a covering member made from a highly elastic resin material, it is possible to obtain an electric wire which achieves both light weight and high reliability by combining the twisted wire conductors having such a configuration.

A reason why the springback can be reduced by the twisted wire conductor whose recess depth is limited is considered, for example, as follows but is not limited thereto. In such a twisted wire conductor, an adhesive force with the covering member is reduced to a certain strength or less. Therefore, when the electric wire is curved by an external force, microscopic slippage occurs between the twisted wire conductor and the covering member, an internal stress is easily relieved, and a restoring force of the electric wire is easily maintained at a certain value or less. Furthermore, since such a twisted wire conductor exhibits mechanical characteristics close to a conductor consisting of a single strand, that is, a single wire compared with a general twisted wire or a common compression conductor, the bent shape is easily maintained.

MODES FOR CARRYING OUT THE INVENTION

Figure 1B:
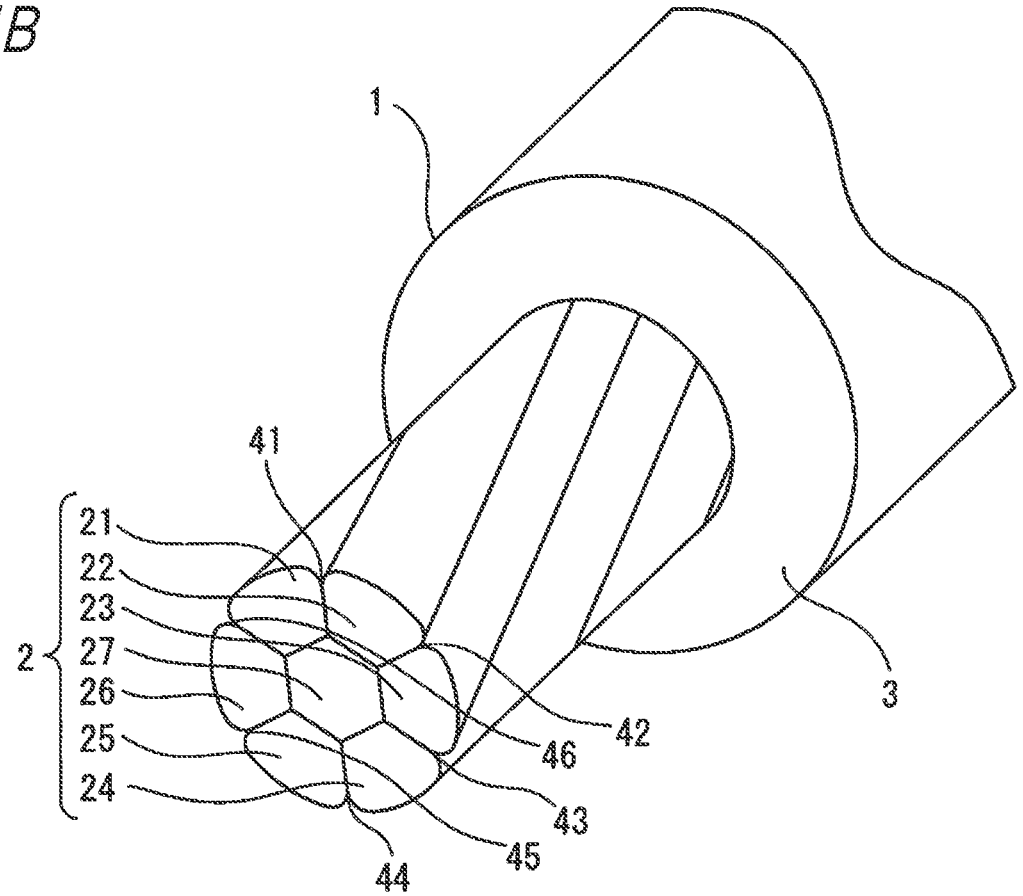

FIGS. 1A and 1B are views showing an example of an electric wire 1 according to the claims of the present application. FIG. 1A is a cross-sectional view of the electric wire 1 viewed from a length direction. FIG. 1B is a perspective view of the electric wire 1.

The electric wire 1 includes a twisted wire conductor 2 compression molded by twisting seven strand conductors 21 to 27 and a covering member 3. The covering member 3 covers the twisted wire conductor 2 so that an inner wall contacts with an outer peripheral surface of the twisted wire conductor 2.

The twisted wire conductor 2 is compression molded by twisting seven strand conductors 21 to 27. Since a plurality of strand conductors are twisted, the twisted wire conductor 2 is excellent in flexibility and has a strong characteristic to flex and contort as compared with an electric wire formed of a single conductor. In addition, since the twisted wire conductor 2 is compression molded, the diameter of the electric wire 1 can be reduced.

Each of the strand conductors 21 to 27 is deformed by compression molding. The twisted wire conductor 2 has the strand conductor 27 deformed in a hexagonal shape at the center in a cross-sectional view and has six strand conductors 21 to 26 deformed by compression around the strand conductor 27. Each of the seven strand conductors before compression molding has a circular cross section, and is, for example, a conductor made from a copper wire having a diameter $\varphi_1$ of 0.1 mm or more and 0.4 mm or less. Preferably, the seven strand conductors before compression molding have the same diameter and the same raw material. This is because it is possible to form a twisted wire conductor having a uniform diameter with little disconnection even though wire twisting is performed by having the same diameter and the same raw material.

The strand conductors 21 to 27 may be plated copper wires. When the strand conductors 21 to 27 are plated copper wires, a plating surface may be formed of a metal having a low recrystallization temperature such as tin (Sn). In a case of plating with a metal having a low recrystallization temperature, microscopic roughness of the plating surface generated when the strand conductors 21 to 27 are compression molded is easy to decrease with heating in an annealing treatment and aging, and improvement in slippage properties to the covering member 3 is expected. In addition, in the case of plating with a metal having a low recrystallization temperature, the strand conductors 21 to 27 are not cured, so that bending performance is improved. Alternatively, the plating surface may be nickel (Ni). Since nickel has a high hardness, a surface of the strand conductor is protected, so that surface damage during handling is reduced, and improvement in adhesion to a resin can be reduced. Further, it is suitable for an electric wire that requires long-term reliability at high temperature. Silver (Ag) plating is particularly suitable. The silver plating improves workability and reliability by improving lubricity of the surface of the strand conductor at the time of wiring, and meanwhile the plating surfaces of the strands are diffusion bonded together with the passage of time after the wiring is completed to reduce slippage, and an effect of reducing spring back is obtained. Such a characteristic is particularly suitable as the electric wire for a flying object.

The covering member 3 covers the twisted wire conductor 2 so that an inner wall contacts with an outer peripheral surface of the twisted wire conductor 2. Further, the flexibility and rigidity of the electric wire 1 can be made appropriate by adjusting the raw material and thickness of the covering member 3. The covering member 3 is formed of, for example, an insulating material such as a fluorine-based polymer resin. This is to insulate and protect the twisted wire conductor 2. The insulating material that forms the covering member 3 may be a thermoplastic fluororesin or a polyimide, particularly preferably a crosslinked thermoplastic resin or polyether ether ketone.

Here, the covering member 3 is preferably a resin material having a flexural modulus at 23° C. of 0.6 GPa or more, more preferably 0.8 GPa or more, and particularly preferably 1.5 GPa or more. By applying a resin material having a high elastic modulus, it is possible to improve reliability against a mechanical stress. In addition, when a twisted wire conductor having a compression ratio to be described later is covered, occurrence of a kink can be prevented.

The flexural modulus may be measured in accordance with ISO178 ASTM D790 or may refer to a catalog value of the resin material.

The flexural modulus of the covering member 3 can be adjusted by controlling crosslinking or crystallinity by not only the kind of a resin and the kind and amount of an additive but also a temperature profile or the like at the time of forming the covering member 3.

Six recesses 41 to 46 are formed at the outer periphery of the twisted wire conductor 2. The recess is a void in which the twisted wire conductor 2 is not filled. By providing a recess having an appropriate depth between the twisted wire conductor 2 and the covering member 3, slipperiness between the twisted wire conductor 2 and the covering member 3 is adjusted. For description, in FIGS. 1A and 1B, the recess is shown to be large enough to understand the shape. An actual size of the recess is preferably smaller than the drawings as defined separately. The same applies to the following drawings unless particularly described.

In addition, it is preferable to include a recess not filled with the covering member 3. In this way, by providing a region where the covering member 3 and the twisted wire conductor 2 are separated in the recess of the electric wire, appropriate slipperiness can be obtained between the twisted wire conductor 2 and the covering member 3. When the recess between the strands is limited to a small depth like the electric wire according to the claims of the present application, the inside of the recess is relatively easily filled with the covering member 3. Even in such a case, for example, by adjusting temperature, pressure, time, and the like of the covering member 3 at the time of forming the covering member 3, and/or by a shape of a mold, etc. it is possible to reduce intrusion of the covering member 3 into the recess and obtain an electric wire including the recess not filled with the covering member 3.

The recess may be filled with a second resin having a smaller flexural modulus than the resin constituting the covering member 3. However, since the flying object is required to have reliability in low atmospheric pressure or vacuum, it is preferable to use a material in which generation of out-gas is reduced even in such an environment.

Alternatively, the recess may be filled with a gas mainly composed of gas having small reactivity such as nitrogen or argon, and may be particularly preferably a space in which surrounding atmosphere in which the electric wire is placed is present. Such gas may also be one of the out-gas, but a risk of contamination of the surrounding environment is small. Further, since the recess is formed continuously in the length direction of the electric wire, the pressure is lowered to the same pressure as the surrounding atmosphere in a relatively short time, and the amount of out-gas thereafter is reduced to a small amount even though the out-gas is generated.

A diameter $\varphi_2$ (mm) of the twisted wire conductor 2 is a measured maximum diameter.

The compression ratio is defined by metal occupancy viewed from a cross section=(total cross-sectional area of conductor strands/area of circle having $\varphi_2$ as diameter)×100 (%).

The compression ratio (%) of the twisted wire conductor 2 may be 85(%) or more and 99(%) or less. Preferably, the compression ratio (%) of the twisted wire conductor is 90(%) or more and 99(%) or less. More preferably, the compression ratio (%) of the twisted wire conductor is 95(%) or more and 99(%) or less.

High compression ratio=the diameter can be reduced even at the same thickness, and thus, springback can be reduced by reducing a shape effect of the covering member 3.

A thickness of the covering member 3 is t (mm). The thickness t (mm) of the covering member 3 is an average value of measured values obtained by measuring the thickness of the covering member 3 in at least two places. An optical microscope with a dimension measuring function is used to measure the thickness of the covering member 3.

The maximum diameter of the twisted wire conductor 2 is preferably 30(%) or more and 85(%) or less of an outer diameter of the covering member 3. More preferably, it is 35(%) or more and 75(%) or less of the outer diameter of the covering member. The flexibility and rigidity of the electric wire 1 can be made appropriate by adjusting the maximum diameter of the twisted wire conductor 2 and the thickness of the covering member 3.

As shown in FIG. 1B, the recesses 41 to 46 formed on the outer periphery of the twisted wire conductor 2 form six grooves extending spirally in an axial direction of the electric wire.

Figure 2:
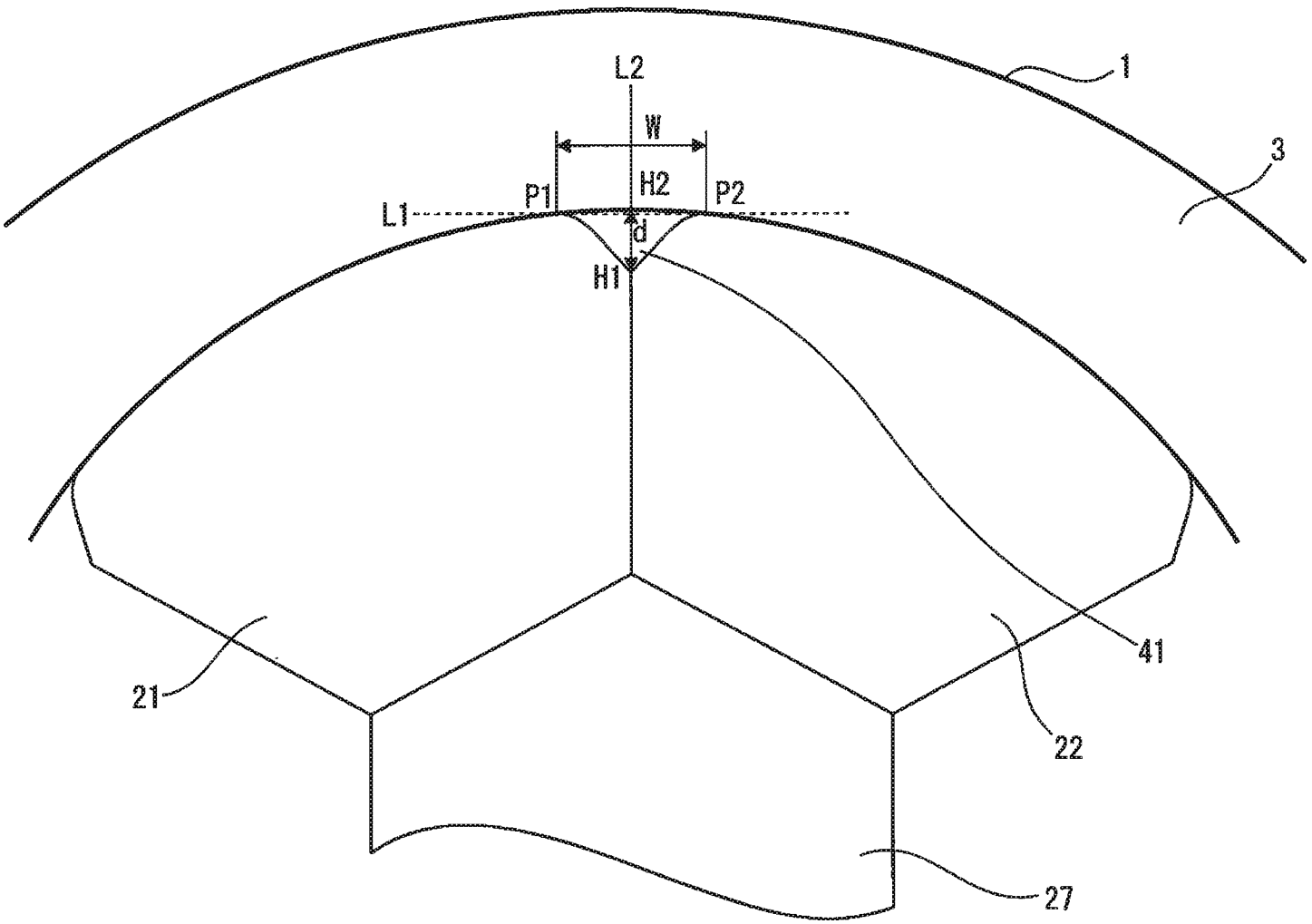
FIG. 2 is an enlarged partial cross-sectional view of the electric wire in a radial direction.

FIG. 2 is an enlarged partial view of a cross-sectional of the electric wire 1 in a radial direction. It is shown that the recess 41 is formed by the center strand conductor 27, the two strand conductors 21 and 22, and the covering member 3.

A method of defining a width w (mm) and a depth d (mm) of the recess 41 will be described with reference to FIG. 2. First, an operator determines a first straight line L1 in contact with the two strand conductors 21 and 22 separately. Next, the operator determines a first contact point P1 and a second contact point P2 where the first straight line L1 determined by the operator and the two strand conductors 21 and 22 are in contact. Next, the operator determines a length of the first straight line L1 between the first contact point P1 and the second contact point P2 as the width w (mm) of the recess 41. Next, the operator determines a contact point H1 between the two strand conductors 21 and 22. The contact point H1 between the two strand conductors 21 and 22 is a deepest point of the recess 41. Next, the operator defines a second straight line L2 extending from a contact point H2 in a direction orthogonal to the first straight line L1. Next, the operator determines an intersection H2 between the second straight line L2 and an inner wall of the covering member 3. Then, the operator determines a length of the second straight line L2 between the contact point H1 and the intersection H2 as a depth d (mm) of the recess 41. The width w (mm) and d (mm) of the recess may be automatically measured by, for example, a computer having an image processing function.

The width w (mm) and the depth d (mm) of the recess 41 can be determined using an optical microscope with a scale by capturing a cross section in the radial direction of the electric wire 1 and using a captured image of the cross section in the radial direction of the electric wire 1. The captured image may be a photograph printed on a printing paper or an image displayed on a display device such as a digital display device. Since the electric wire 1 of the present embodiment has six recesses, the width w (mm) and the depth d (mm) of the recess are defined as the average values of respective widths w (mm) and depths d (mm) of the six recesses.

Further, the depth d (mm) of the recess is an example showing a compression ratio when the twisted wire conductor 2 is compression molded, but the compression ratio at the time of compression molding the twisted wire conductor 2 may be indicated by another index. For example, in a case where variation in depths of a plurality of recesses in the same cross section is large, it may be defined, when the depth d (mm) of the recess is observed in the cross section (prepared by polishing after resin embedding) with an optical microscope (100 to 800 times) and six divisions (each 60 degrees) are made by a plurality of straight lines passing through the center or the center of gravity of the twisted wire conductor 2, as an average value of differences between a maximum diameter and a minimum diameter in each region.

By limiting the depth of the recess formed at the outer periphery of the twisted wire conductor 2, the slipperiness between the twisted wire conductor 2 and the covering member 3 can be adjusted. By adjusting the slipperiness between the twisted wire conductor 2 and the covering member 3, bendability of the electric wire 1 can be adjusted, and the springback can be reduced. In the electric wire 1, when the diameter of the twisted wire conductor is $\varphi_2$ (mm), a proportion $d/\varphi_2$(%) of the depth d (mm) of the recess to the diameter $\varphi_2$ (mm) of the twisted wire conductor is preferably 5(%) or less. More preferably, the proportion (%) of the depth d (mm) of the recess to the diameter $\varphi_2$ (mm) of the twisted wire conductor is 3(%) or less.

The depth d (mm) of the recess is preferably 0.5 (mm) or less, more preferably 0.2 (mm) or less.

On the other hand, when the depth of the recess is extremely small, the twisted wire conductor behaves like a single wire so that flexure resistance may deteriorate significantly, and therefore, a ratio (%) of the depth d (mm) of the recess to the diameter $\varphi_2$ (mm) of the twisted wire conductor is preferably 0.1(%) or more, more preferably 0.5% or more.

(Method of Producing Compressed Twisted Wire Conductor)

Figure 3A:
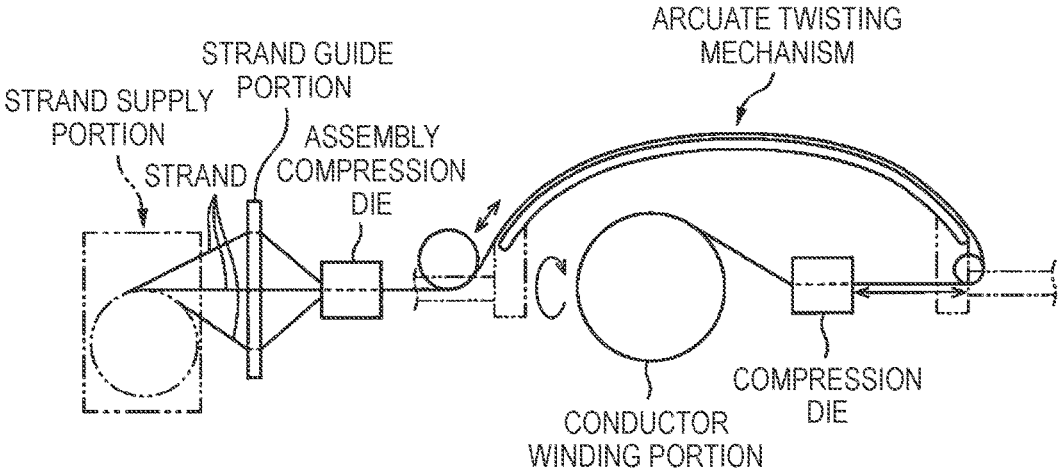
FIGS. 3A, 3B, and 3C are diagrams illustrating an example of a method of producing a compressed twisted wire conductor.
Figure 3B:
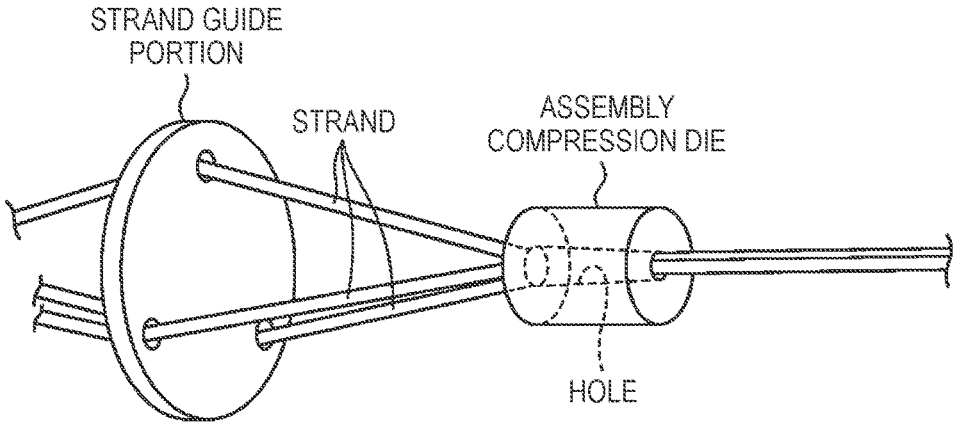
Figure 3C:
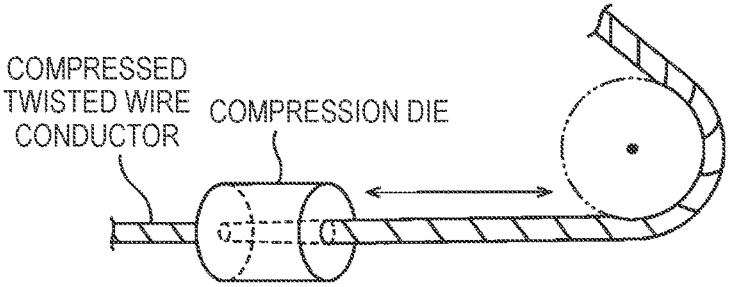

FIGS. 3A, 3B, and 3C are diagrams illustrating an outline of an embodiment of a method of producing a compressed twisted wire conductor. FIG. 3A is a diagram illustrating an outline of a process of manufacturing the twisted wire conductor 2 in which a plurality of strand conductors are twisted and compressed. FIG. 3B is a diagram illustrating a first compression. FIG. 3C is a diagram illustrating a second compression.

The plurality of strands are drawn out from a strand supply portion, are fed to an assembly compression die through a strand guide portion, and are assembled and compressed. After that, the assembled conductor is twisted by an arcuate twisting mechanism, and then, is compressed again with the compression die, and is wound and housed in a conductor winding portion.

FIG. 3B shows the assembly compression die used for the first compression. The assembled compression die has an insertion port having a diameter of such an extent that a plurality of strand conductors can be inserted. A discharge port having a smaller diameter than the insertion port is provided at an opposite side of the insertion port. The plurality of assembled strands are gradually compressed by passing through a hole from the insertion port toward the discharge port.

FIG. 3C shows a compression die for performing compression again. The compression die has a hole for further compressing the twisted wire conductor. The twisted wire conductor twisted by the arcuate twisting mechanism is gradually compressed by being directed from one end side opening of the hole toward the other end side opening having a smaller diameter than the one end side opening, and is compressed into a compressed twisted wire conductor having a target diameter corresponding to the diameter of the other end side opening.

(Method of Covering the Twisted Wire Conductor with the Covering Member)

Figure 4A:
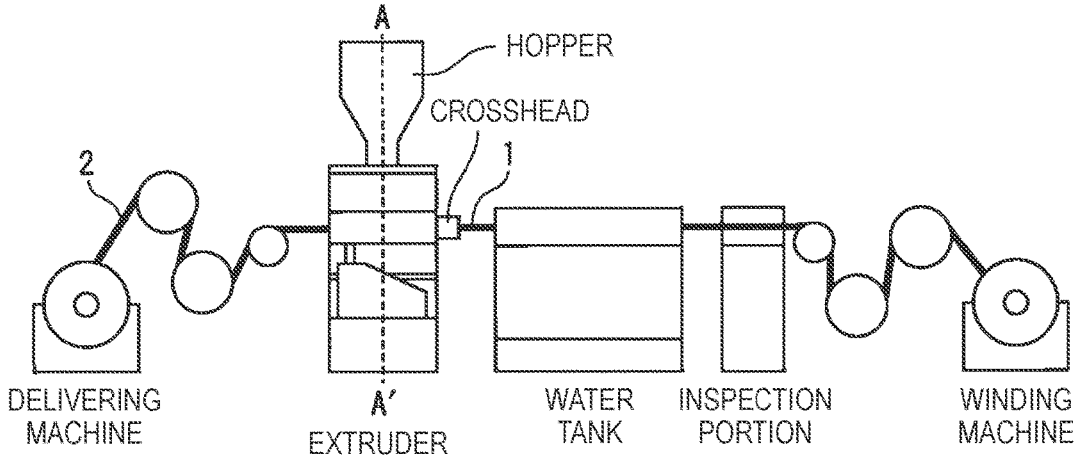
FIGS. 4A, 4B, and 4C are diagrams illustrating an example of a method of covering the twisted wire conductor with a covering member.
Figure 4B:
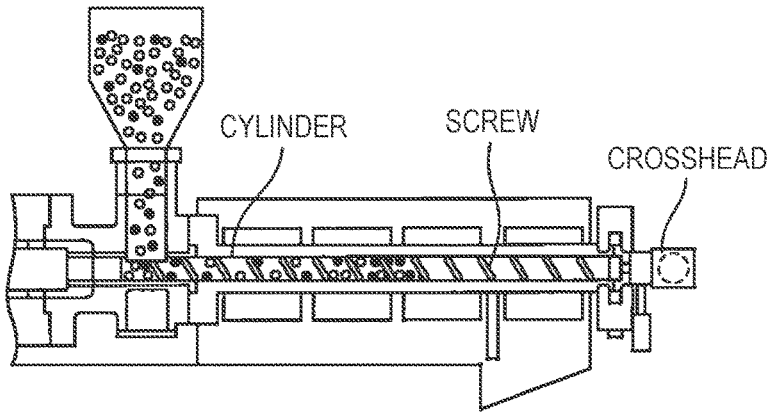
Figure 4C:
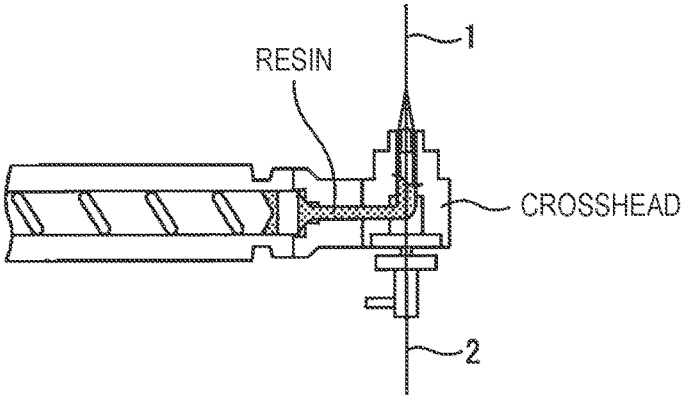

FIGS. 4A, 4B, and 4C are diagrams illustrating an outline of an Example of a method of covering the twisted wire conductor 2 with the covering member 3. FIG. 4A is a diagram illustrating a process outline of the method of covering the twisted wire conductor 2 with the covering member 3. FIG. 4B is a diagram showing main parts of a cross section of an extruder at a position of a line A-A' in FIG. 4A, and FIG. 4C is a diagram of a cross head portion of FIG. 4B viewed from above.

The twisted wire conductor 2 is delivered to the extruder by a delivering machine. Resin pellets (resin particles) serving as the covering member are thrown into a hopper provided at an upper portion of the extruder. The thrown resin pellets are heated and melted and extruded around the twisted wire conductor 2 by a crosshead of the extruder. The extruded electric wire 1 is cooled by passing through a water tank. The cooled electric wire is wound by the winding machine through an inspection portion.

FIG. 4B is a diagram showing main parts of a cross section of an extruder at a position of a line A-A' in FIG. 4A. The resin pellets thrown into the hopper are heated in a cylinder, and the melted resin is extruded by a screw while being kneaded.

FIG. 4C is a diagram of a cross head portion viewed from above. The extruded fluorine-based polymer resin is applied on the twisted wire conductor 2 through a mold in the crosshead at the tip so as to become the covering member 3 having a uniform thickness.

Although the electric wire using the twisted wire conductor made from seven strand conductors has been described in the above example, the electric wire according to the present invention is not limited to seven strand conductors, and may be a plurality of strand conductors. However, when the number of the strand conductors constituting the twisted wire conductor is extremely large, the electric wire becomes flexible so that it is difficult to obtain an effect of reducing the springback. Therefore, the number of the strand conductors constituting the twisted wire conductor is preferably 19 or less, particularly preferably 7 or less. In addition, since a high compression ratio is easily obtained, the twisted wire conductor is preferably composed of 19 strand conductors, particularly preferably composed of 7 strand conductors.

Hereinafter, the electric wire according to the claims of the present application will be described in more detail using Examples.

(Example 1) A twisted wire drawing wire (YS conductor) manufactured by SANSHU-DENSEN composed of seven silver plated soft copper wires was prepared. This twisted wire conductor has a high compression ratio as compared with a common compressed electric wire, and a depth of the recess between the strands is limited to very small of 5% or less with respect to an outer diameter of the conductor, and thus, the twisted wire conductor macroscopically has an outer shape closer to a single wire than a general twisted wire.

A covering member was formed on the outer peripheral surface of the twisted wire conductor by the method described above. A material of the covering member was ETFE manufactured by AGC Inc. that is Fluon (registered trademark), and a thickness of the covering member on the twisted wire conductor was approximately 0.25 mm.

(Example 2) Although it differs from Example 1 in that the thickness of the covering member formed on the outer peripheral surface of the twisted wire conductor is 0.15 mm, others have the same configuration as that of Example 1.

(Comparative Example 1) Although it differs from Example 1 in that the twisted wire conductor is not compressed and the depth of the recess between the strands greatly exceeds 5% with respect to the outer diameter of the conductor, others have the same configuration as that of Example 1.

These outlines are shown in Table 1.

TABLE 1

| | Twisted wire conductor | | | Covering member | |
|---|---|---|---|---|---|
| | Total cross-sectional area of strand conductor ($mm^2$) | Conductor outer diameter (mm) | Recess depth/Conductor outer diameter | Material | Thickness (mm) |
| Example 1 | 0.23 | 0.54 highly compressed) | 5% or less | ETFE | 0.25 |
| Example 2 | 0.23 | 0.54 (highly compressed) | 5% or less | ETFE | 0.15 |
| Comparative Example 1 | 0.23 | 0.609 (uncompressed) | 10% or more | ETFE | 0.25 |

(Evaluation of Shape Maintenance Characteristic)

Figure 5A:
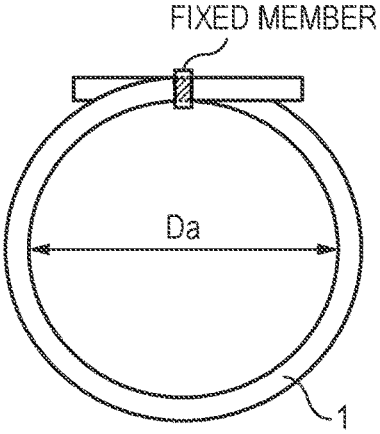
FIGS. 5A, 5B, and 5C are diagrams illustrating a method of evaluating the shape maintenance characteristics of the electric wire.
Figure 5B:
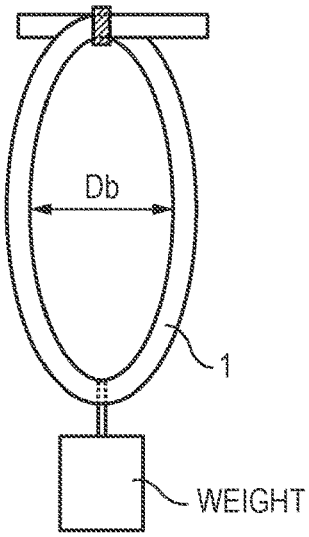
Figure 5C:
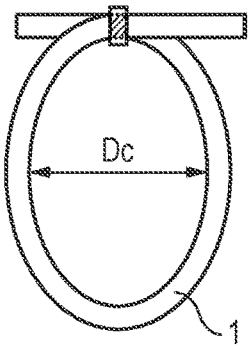

The shape maintenance characteristic of the above-recited electric wire was evaluated. FIGS. 5A, 5B, and 5C are diagrams illustrating a test method. The electric wire cut to an appropriate length was curved to be a circle having an inner diameter Da of 100 mm, and a crossing position of the electric wire was fixed with a fixing member (for example, an adhesive tape) over a width of 20 mm (FIG. 5A). After hanging the circular electric wire at the position of the fixing member, a weight was hung gently at a lower end position, and a load in a vertical direction of 150 gf was applied. An inner diameter Db of the electric wire deformed by the load was measured 5 seconds after the load application was started (FIG. 5B). Then, the load was removed and an inner diameter Dc of the wire after 5 seconds was measured. Here, any of the inner diameter Da, the inner diameter Db, and the inner diameter Dc can be defined as a maximum inner diameter in a horizontal direction of a wheel of the electric wire. In the evaluation method, it is determined that the electric wire having a small inner diameter Dc after removing the load has small springback and has shape maintainability.

Figure 6:
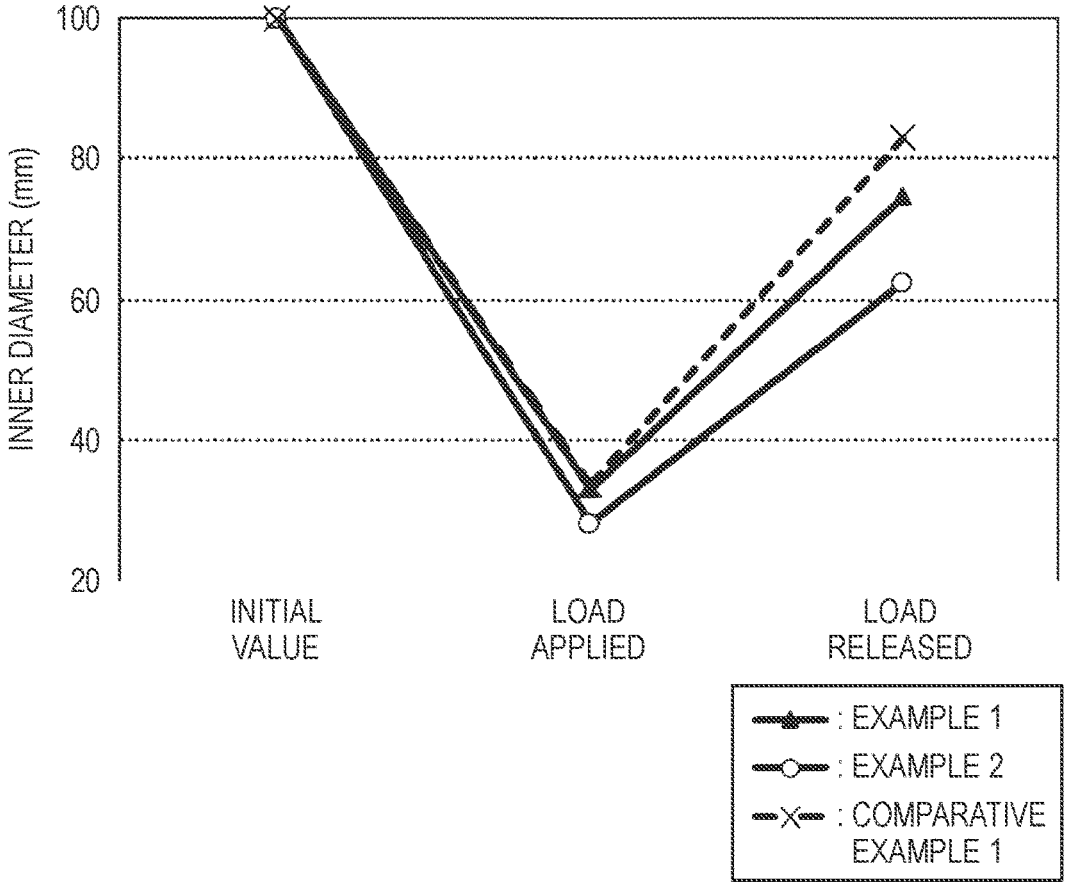
FIG. 6 is a diagram showing evaluation results of the shape maintenance characteristics of the electric wire.

The evaluation results of the shape maintenance characteristic are shown in FIG. 6. In the electric wire according to the claims of the present application in which the depth of the recess is limited small, the springback is reduced, and the shape maintainability is improved. It was confirmed that by reducing the thickness of the covering member to 150 mm or less, the improvement in the shape maintenance characteristic was prominent.

(Regarding Use of Electric Wire According to Present Invention)

The electric wire according to the claims of the present application can be used as, for example, an electric wire of a cable harness for power transmission. In particular, since the electric wire has lightness and high reliability, it is suitable for use as an electric wire provided inside or outside the flying object, particularly suitable for use in the space filed where extremely high lightness and reliability are required.

Further, since the springback is reduced, it is particularly suitable for use as an electric wire formed in three dimensions inside the flying object where space is limited. The electric wire is not limited to power transmission, and may be used for transmission of an electric signal.

Figure 7:
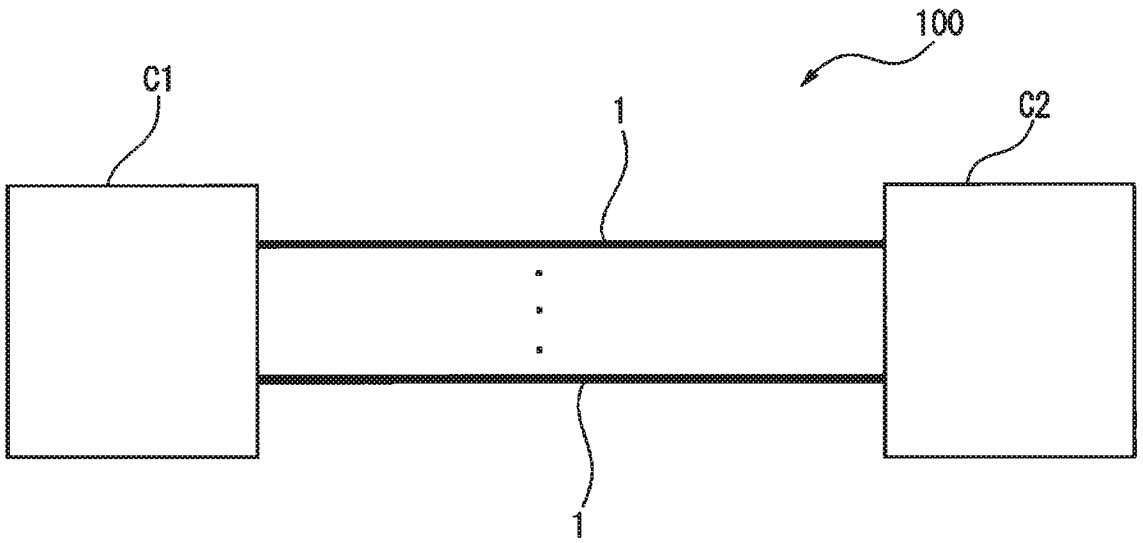
FIG. 7 is a diagram showing an example of a cable harness according to the present invention.

FIG. 7 is a diagram showing an example of a cable harness using the electric wire according to the present invention.

A cable harness 100 includes, for example, one or more electric wires 1 according to the claims of the present application, and includes, on an end of the electric wire, a connector C1 having an electric wire connection portion connectable to the electric wire 1 and an engagement portion electrically connected to the electric wire connection portion and having a conductor engageable with another electrical apparatus. The cable harness 100 may further include, on the other end of the electric wire, a connector C2 having an electric wire connection portion connectable to the electric wire 1 and an engagement portion electrically connected to the wire connection portion and having a conductor engageable with another electrical apparatus. Alternatively, in the cable harness 100, one or both of one end and the other end of the electric wire may be soldered to another electrical apparatus.

The electric wire 1 according to the claims of the present application is suitably applied to the cable harness including one or more connectors. When the engagement of the connector is released due to some factors, the connector may move significantly in a state of being biased by springback. When the biased connector collides with the other device, damage to the connector and/or other devices may be caused. In contrast, in the electric wire according to the claims of the present application, since the springback is reduced, such damage can be reduced.

The electric wire 1 according to the claims of the present application is suitable for a cable harness including a plurality of electric wires. In such a cable harness, a plurality of electric wires are bundled by a connector formed at the end portion and/or a binding member (not shown) provided on the electric wire. A shape restoring force of the cable harness increases as the number of the electric wires increases, and as a result, a problem caused by springback easily becomes apparent. In contrast, by providing a plurality of electric wires 1 according to the claims of the present application, a cable harness having excellent reliability in which springback is reduced is provided. It is suitable for a cable harness including 8 or more electric wires 1, particularly suitable for a cable harness including 16 or more electric wires 1.

In particular, when the connector and the plurality of electric wires are not arranged in a straight line and are arranged two-dimensionally such as a matrix shape or a zigzag shape, the springback increases. Even in such a case, by including the electric wire 1 according to the claims of the present application, a cable harness having excellent reliability in which springback is reduced is provided.

The cable harness 100 may include three or more connectors. For example, the electric wire 1 including two systems of a first system and a second system may be connected to an electrical connection portion of the connector C1, one or more electric wires 1 of the first system may be connected to an electrical connection portion of the connector C2, and one or more electric wires 1 of the second system may be connected to an electrical connection portion of another connector C3 (not shown).

In addition, the cable harness 100 is not preferable to be long in view of weight when used for a flying object. The length of the cable harness 100 is preferably 10 m or less, particularly preferably 3 m or less.

Figure 8:
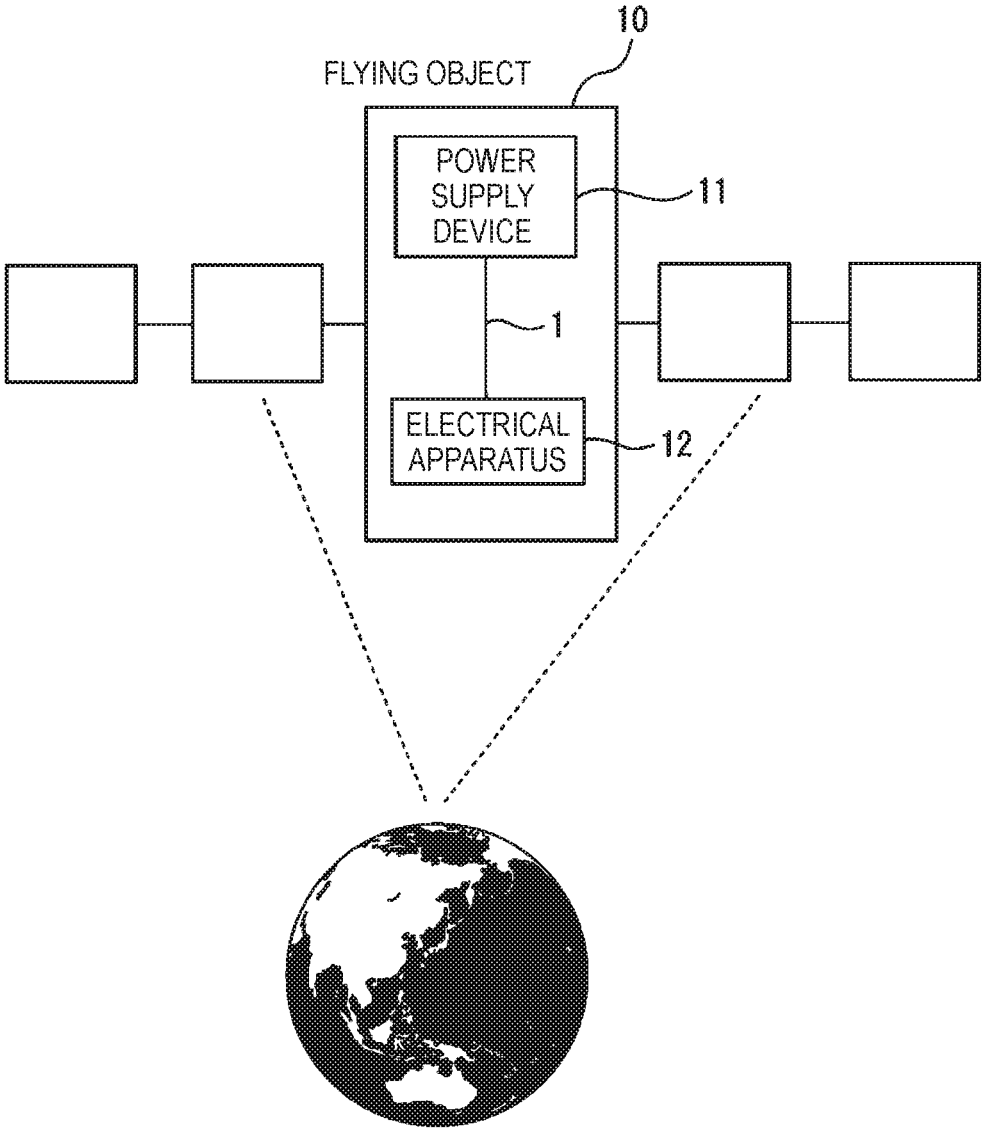
FIG. 8 is a diagram showing an example of a flying object according to the present invention.

FIG. 8 is a diagram showing an example of a flying object using the electric wire according to the present invention.

An interior of a flying object 10 includes, for example, a power supply device 11 capable of supplying electric power, an electric wire 1 according to the present invention electrically connected to the power supply device 11, and an electrical apparatus 12 electrically connected to the electric wire 1 and driven by electric power supplied from the power supply device.

Figure 9:
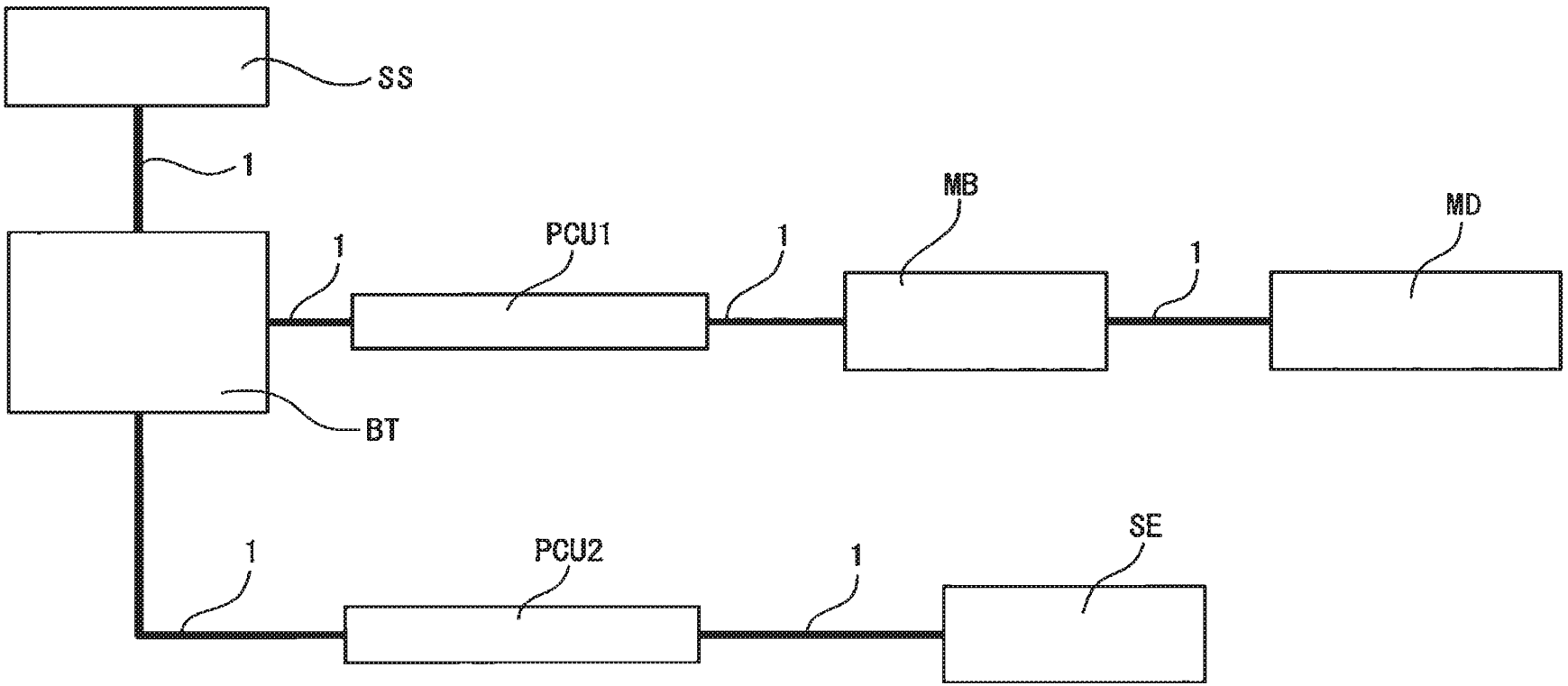
FIG. 9 is a diagram showing an example of using electric wires in the flying object according to the present invention.

FIG. 9 is a diagram showing an example of using electric wires according to the present invention in the flying object.

The flying object 10 includes, for example, a power generation device SS made from a solar cell or the like, an internal power supply BT capable of storing electric energy supplied from the exterior and supplying the stored electric energy to the exterior, power supply control units PCU1 and PCU2, a motherboard MB, a mission device MD including a sensor, an actuator, and the like, and a flying object driving device SE such as a thruster engine.

The electric power generated by the solar cell SS provided outside the flying object 10 is stored in the internal power supply BT via one or more electric wires 1. Electric power is supplied from the internal power supply BT to the power supply control unit PCU1 via one or more electric wires 1. Further, electric power of a motherboard MT is supplied from the power supply control unit PCU1 via one or more electric wires 1. The electric power supplied to the motherboard MB is distributed to one or more mission devices MD via one or more electric wires 1.

Moreover, electric power is supplied from the internal power supply BT to the power supply control unit PCU2 via one or more electric wires 1. Further, electric power is supplied from the power supply control unit PCU2 to a thruster engine SE via one or more electric wires 1.

Since the electric wire according to the present invention has light weight and reliability, and furthermore, springback is unlikely to occur by the electric wire, it can be used in, for example, a flying object that flies in space. The flying object that flies in space is, for example, a satellite that orbits the earth or a rocket.

Since the flying object 10 that flies in space flies in a space close to a vacuum, it is necessary to reduce generation of gas generated in the flying body. The electric wire 1 according to the present invention uses a resin that is unlikely to generate gas, such as a fluorine resin, a crosslinking thermoplastic fluorine resin, a polyimide, and a polyether ether ketone. Further, when an electric wire having a compressed twisted wire conductor is used, the amount of resin can be reduced, gap can be reduced, and the electric wire has lighter weight as compared with an uncompressed twisted wire conductor.

It should be understood by those skilled in the art that various changes, substitutions, and modifications may be added thereto without departing from the spirit and scope of the present invention.

DESCRIPTION OF REFERENCE NUMERALS

1 Electric wire
2 Twisted wire conductor
3 Covering member
21, 22, 23, 24, 25, 26, 27 Strand conductor
41, 42, 43, 44, 45, 46, 47 Recess
10 Flying object
11 Power supply device
12 Electrical apparatus
100 Cable harness
C1, C2 Connector

The invention claimed is:

1. An electric wire comprising:

a twisted wire conductor comprising a plurality of strand conductors twisted together with each other and having a total cross-sectional area of the plurality of strand conductors of 2 mm2 or less; and a covering member made from a resin material having a flexural modulus of 0.6 GPa or more and covering the twisted wire conductor so that an inner wall of the covering member is in contact with an outer peripheral surface of the twisted wire conductor, wherein the twisted wire conductor has, on an outer peripheral surface thereof, recesses having a depth of 5% or less of a maximum diameter of the twisted wire conductor in a cross section perpendicular to a length direction of the twisted wire conductor and containing boundaries of the plurality of strand conductors.

2. The electric wire according to claim 1, wherein the depth of the recesses is 3% or less of the maximum diameter of the twisted wire conductor.

3. The electric wire according to claim 1, wherein the depth of the recesses is 0.5% or more of the maximum diameter of the twisted wire conductor.

4. The electric wire according to claim 1, wherein the depth of the recesses is 0.2 mm or less.

5. The electric wire according to claim 1, wherein, in the recesses, an outer peripheral surface of the twisted wire conductor is separated from the covering member.

6. The electric wire according to claim 1, wherein the plurality of strands is made from seven strands.

7. The electric wire according to claim 1, wherein the twisted wire conductor is a compressed twisted wire conductor.

8. The electric wire according to claim 7, wherein a compression ratio of the compressed twisted wire conductor is 90% or more.

9. The electric wire according to claim 1, wherein the maximum diameter of the twisted wire conductor is 30% or more and 85% or less of an outer diameter of the covering member.

10. The electric wire according to claim 1, wherein an outer diameter of the covering member is 0.4 mm or more and 3 mm or less.

11. The electric wire according to claim 1, wherein the covering member contains one or more of resins selected from a group consisting of polyether ether ketone, thermoplastic fluorine resin, crosslinking thermoplastic fluorine resin, and polyimide.

12. A cable harness comprising:

the electric wire according to claim 1; and a connector that is connected to the electric wire and has an engagement portion engageable with another electrical apparatus.

13. A flying object comprising:

the cable harness according to claim 12; and the electrical apparatus.

14. The electric wire according to any one of claim 5, wherein the twisted wire conductor is a compressed twisted wire conductor.

15. The electric wire according to claim 5, wherein the maximum diameter of the twisted wire conductor is 30% or more and 85% or less of an outer diameter of the covering member.

16. The electric wire according to claim 5, wherein an outer diameter of the covering member is 0.4 mm or more and 3 mm or less.

17. The electric wire according to claim 5, wherein the covering member contains one or more of resins selected from a group consisting of polyether ether ketone, thermoplastic fluorine resin, crosslinking thermoplastic fluorine resin, and polyimide.

18. The electric wire according to claim 15, wherein an outer diameter of the covering member is 0.4 mm or more and 3 mm or less.

19. A cable harness comprising:

the electric wire according to claim 18; and a connector that is connected to the electric wire and has an engagement portion engageable with another electrical apparatus.

20. A flying object comprising:

the cable harness according to claim 19; and the electrical apparatus.

21. The electric wire according to claim 1, wherein the flexural modulus of the resin material is 1.5 GPa or more.

22. The electric wire according to claim 11, wherein the covering member contains polyether ether ketone.

23. The electric wire according to claim 11, wherein the covering member contains one or more of resins selected from a group consisting of thermoplastic fluorine resin and crosslinking thermoplastic fluorine resin.

24. The electric wire according to claim 1, wherein the plurality of strand conductors twisted together with each other is a plurality of copper wires twisted together with each other, and each of the plurality of copper wires has a surface layer plated with a metal selected from a group consisting of tin, nickel and silver.

25. The electric wire according to claim 1, wherein at least one of the recesses is not filled with the covering member.

26. The electric wire according to claim 5, wherein the flexural modulus of the resin material is 1.5 GPa or more.

27. The electric wire according to claim 17, wherein the covering member contains polyether ether ketone.

28. The electric wire according to claim 17, wherein the covering member contains one or more of resins selected from a group consisting of thermoplastic fluorine resin and crosslinking thermoplastic fluorine resin.

* * * * *